US006321635B1

(12) United States Patent
Fujita

(10) Patent No.: US 6,321,635 B1
(45) Date of Patent: Nov. 27, 2001

(54) SWASH PLATE TYPE COMPRESSOR IN WHICH LUBRICATING OIL IS EFFECTIVELY SUPPLIED TO A SHOE MECHANISM INTERPOSED BETWEEN A PISTON AND A SWASH PLATE

(75) Inventor: Masaaki Fujita, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/397,870

(22) Filed: Sep. 17, 1999

(30) Foreign Application Priority Data

Sep. 22, 1998 (JP) ..... 10-267578

(51) Int. Cl.[7] ..... F01B 3/00; F01B 31/10

(52) U.S. Cl. ..... 92/71; 92/154; 92/160; 417/269

(58) Field of Search ..... 92/12.2, 57, 71, 92/154, 158, 160; 417/269

(56) References Cited

U.S. PATENT DOCUMENTS 3,153,987 * 10/1964 Thoma ..... 92/158 X
3,915,071 * 10/1975 Forster ..... 92/158 X
4,216,704 * 8/1980 Heyl ..... 92/158 X
5,072,655 * 12/1991 Adler ..... 92/160
5,174,728 * 12/1992 Kimura et al. ..... 92/160 X
5,842,406 * 12/1998 Hiramatsu et al. ..... 92/158

FOREIGN PATENT DOCUMENTS 544641 2/1993 (JP) .

* cited by examiner

*Primary Examiner*—Hoang Nguyen
(74) *Attorney, Agent, or Firm*—Baker Botts L.L.P.

(57) ABSTRACT

In a swash plate type compressor in which a shoe mechanism (23*a* and 23*b*) is slidably interposed between a swash plate (21) and a piston (22) to convert a rotating motion of the swash plate to a reciprocating motion of the piston, lubricating oil is effectively supplied together with a blowby gas to the shoe mechanism. As a result, the lubricating oil favorably lubricates a sliding portion which is between the shoe mechanism and each of the swash plate and the piston. The piston is inserted in a cylinder bore (1) of a cylinder block (2) to have a sealed gap around the piston. When the swash plate is rotatably driven, the piston is reciprocated through the shoe mechanism to compress a gaseous fluid including the lubricating oil. A part of the gaseous fluid passes as the blowby gas through the sealed gap during the reciprocation motion of the piston.

4 Claims, 6 Drawing Sheets

SWASH PLATE TYPE COMPRESSOR IN WHICH LUBRICATING OIL IS EFFECTIVELY SUPPLIED TO A SHOE MECHANISM INTERPOSED BETWEEN A PISTON AND A SWASH PLATE

BACKGROUND OF THE INVENTION

The present invention relates to a swash plate type compressor in which a piston is reciprocated by a swash plate in the manner known in the art.

Such a swash plate type compressor is often included in an air conditioner for an automobile or a vehicle. The swash plate type compressor generally comprises a cylinder block defining a cylinder bore, a piston inserted in the cylinder bore, a swash plate rotatably driven by a driving mechanism known in the art, and a shoe mechanism slidably interposed between the swash plate and the piston. The swash plate is fixed to a driving shaft rotated by a driving source such as an engine mounted on the automobile. The shoe mechanism is for converting a rotating motion of the swash plate to a reciprocating motion of the piston in the manner known in the art. When the swash plate reciprocates the piston, a gaseous fluid is compressed in the cylinder. In case of using the swash plate type compressor in the air conditioner, a refrigerant gas is used as the gaseous fluid and circulates through a refrigerating cycle included in the air conditioner.

If wear or abrasion occurs in a sliding portion between the swash plate and each of the piston and the shoe mechanism, the compressor has reliability which may be significantly reduced. Accordingly, constant lubrication should be ensured for the sliding portion.

In the swash plate type compressor of this kind, lubricating oil is stored in a crankcase, containing the swash plate, in order to lubricate the sliding portion and others. When the swash plate is rotated, the lubricating oil is splashed and attached to the sliding portion by reactions of the swash plate and others.

However, it is hard to obtain the effect of lubrication when the amount of the lubricating oil is small in the crankcase. This is because the lubrication of the sliding portion is conducted without control of the lubricating oil.

As an example for solving such a problem, a compressor is disclosed in Japanese Patent Unexamined Publication No. 5-44641 in which a passage is formed in a piston to conduct a lubricating oil to a sliding portion. However, positive lubrication is not possible because the passage has an oil inlet and an oil outlet which are similar to each other in pressure.

In the manner known in the art, the lubricating oil has a part which leaks from the crankcase and circulates together with the refrigerant gas through the refrigerating cycle. That is, the refrigerant gas in the refrigerating cycle includes the lubricating oil. When the piston is reciprocated, the refrigerant gas has a part which passes as a blowby gas towards the crankcase through a sealed gap left around the piston. In this event, the blowby gas includes the lubricating oil in addition to the refrigerant gas.

SUMMARY OF THE INVENTION

It is therefore an object of the present invention to provide a swash plate type compressor in which lubricating oil is effectively supplied to a shoe mechanism interposed between a piston and a swash plate.

Other objects of the present invention will become clear as the description proceeds.

A swash plate type compressor to which the present invention is applicable is for compressing a gaseous fluid including lubricating oil and comprises a cylinder block defining a cylinder bore, a piston inserted in the cylinder bore to have a sealed gap around the piston and reciprocating to compress the gaseous fluid, the gaseous fluid having a part which passes as a blowby gas through the sealed gap when the piston is reciprocated, a swash plate rotatably driven, a shoe mechanism slidably interposed between the swash plate and the piston for converting a rotating motion of the swash plate to a reciprocating motion of the piston, and supply means connected to the sealed gap for supplying the blowby gas together with the lubricating oil to the shoe mechanism to lubricate a sliding portion which is between the shoe mechanism and each of the swash plate and the piston.

DESCRIPTION OF THE PREFERRED EMBODIMENT

Figure 1:
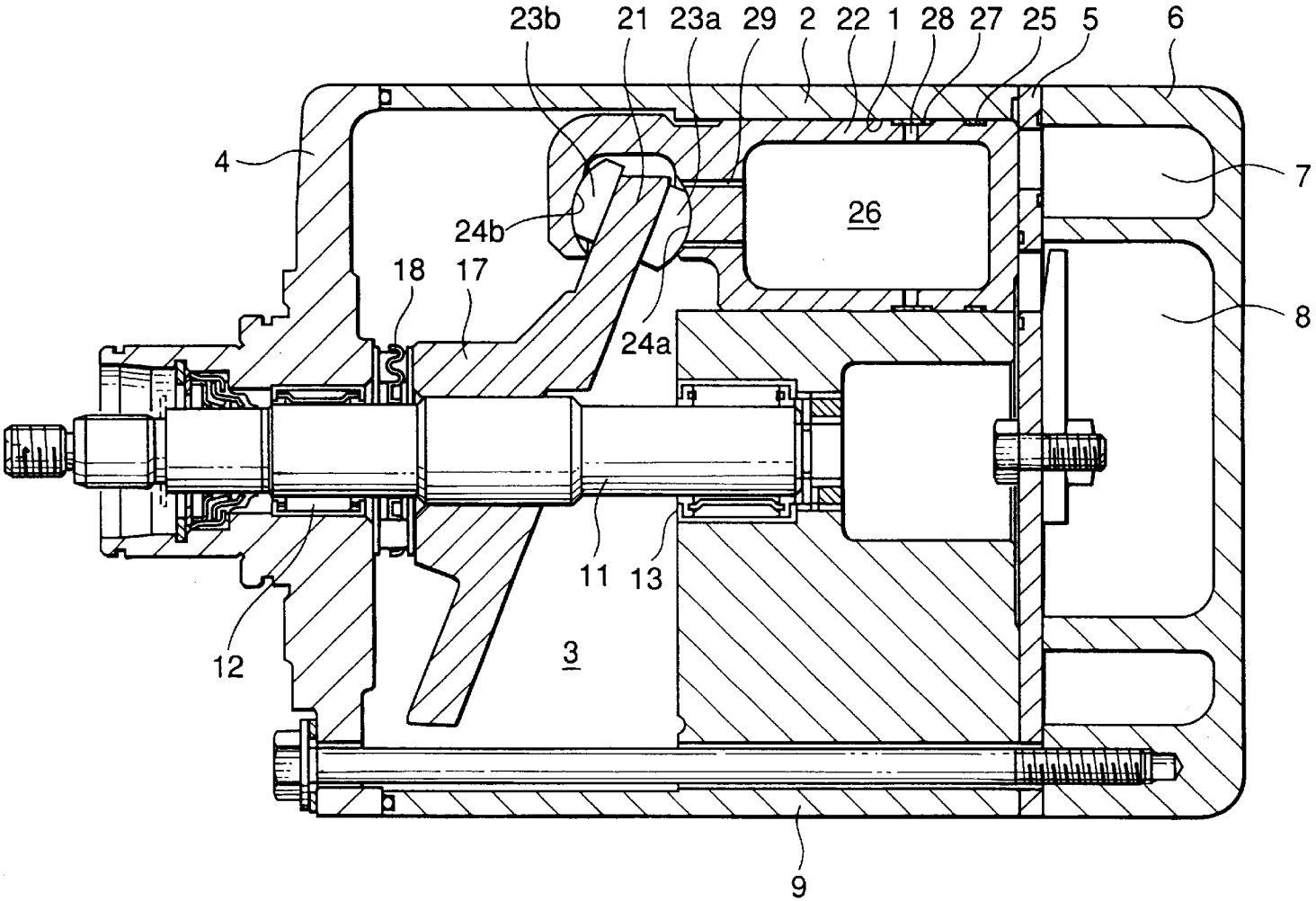
FIG. 1 is a longitudinal sectional view of a swash plate type compressor according to an embodiment of the present invention, in a state where a piston is in the top dead point.
Figure 2:
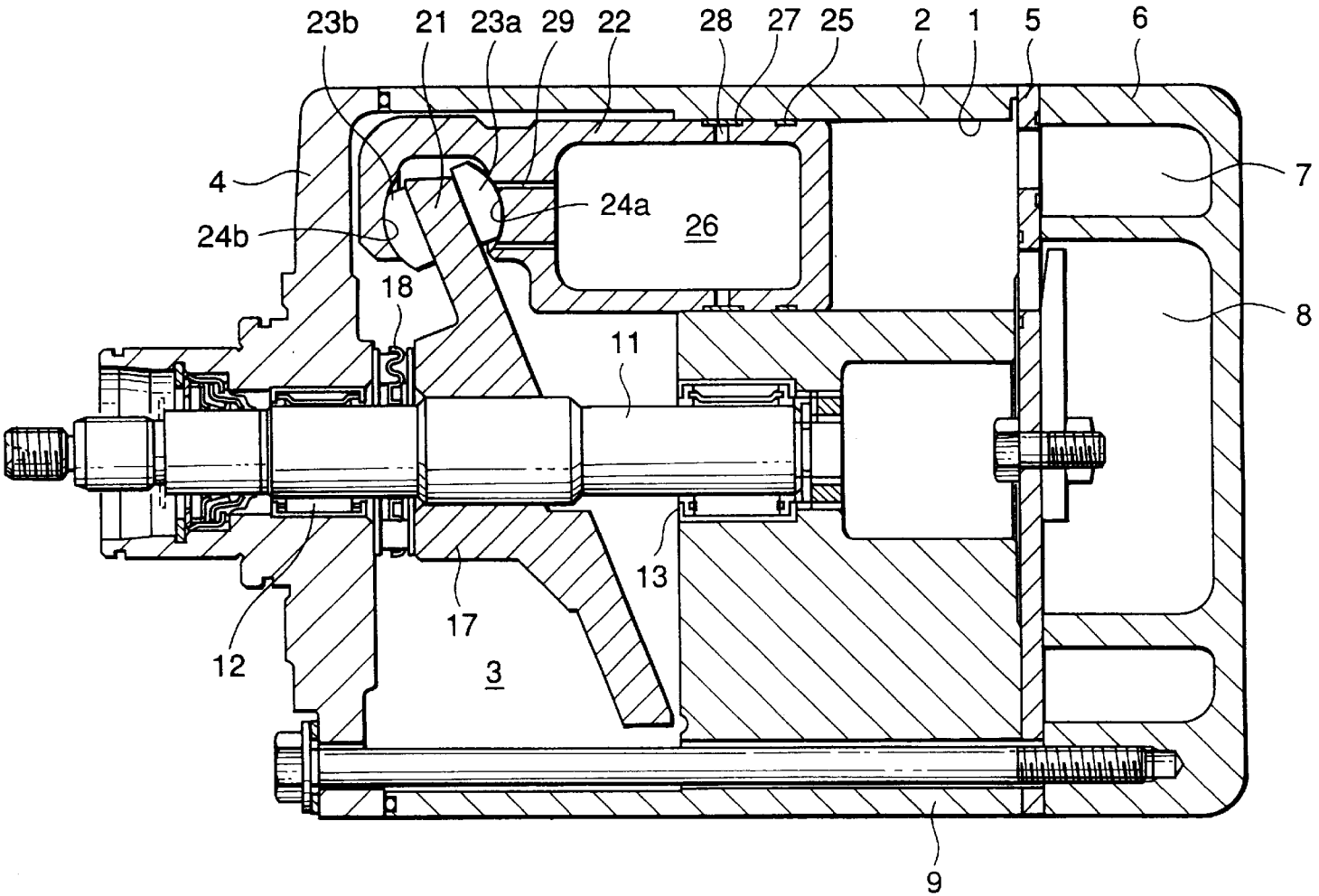
FIG. 2 is a longitudinal sectional view of the swash plate type compressor of FIG. 1 in a state where the piston is in the bottom dead point.

With reference to FIGS. 1 and 2, description will be made as regards a swash plate type compressor according to an embodiment of the present invention.

The swash plate type compressor may be used in a vehicle air conditioner for circulating a refrigerant gas in a refrigerating cycle. The compressor comprises a cylinder block 2 defining or forming a plurality of cylinder bores (only one is illustrated) 1 around the axis of the compressor. A front housing 4 is in contact with an end face of the cylinder block 2 so as to form a crankcase 3 in cooperation with the cylinder block 2. A cylinder head 6 is disposed on the other end face, in an axial direction, of the cylinder block 2 via valve plate assembly 5. The cylinder head 6 defines therein an inlet chamber 7 and a discharge chamber 8. Tie bolts 9 connect the cylinder block 2, the front housing 4, and cylinder head 6 to each other.

A drive shaft 11 penetrates the front housing 4 in the axial direction and is rotatably supported by a radial bearing 12. One end of the drive shaft 4 is rotatably supported to the cylinder block 2 by a radial bearing 13. To the other end of the drive shaft 4, driving force is transmitted from, for example, power of the engine of a vehicle via a belt.

A rotor 17 is fixed to the drive shaft 11 in the crank case 3. The rotor 17 is rotatably supported to the front housing 4 through a thrust bearing 18. Integrally formed with the rotor 17 is a swash plate 21. Accordingly, the swash plate 21 rotates integrally with the drive shaft 11 and the rotor 17.

The swash plate 21 has peripheral plate parts which are engaged with a plurality of pistons (only one is illustrated) 22 through respective pairs of shoes 23*a* and 23*b* on both faces of the plate parts. In detail, each piston 22 has two spherical shoe receiving faces 24*a* and 24*b* facing each other. The shoes 23*a* and 23*b* are disposed between the shoe receiving faces 24*a* and 24*b* and the swash plate 21, respectively. The shoes 23*a* and 23*b* have spherical surfaces confronting the shoe receiving faces 24*a* and 24*b*. Each piston 22 is inserted into the corresponding cylinder bore 1 so that the piston 22 can reciprocate in a direction parallel to the axis in the cylinder bore 1. The piston 22 comprises a piston-sealing member 25 for sealing between the piston 22 and the cylinder bore 1. One or a combination of the shoes 23*a* and 23*b* is referred to as a shoe mechanism which is for converting a rotating motion of the swash plate 21 to a reciprocation motion of the piston 22.

When the drive shaft 11 is driven to rotate, the swash plate 21 also rotates to reciprocate the pistons 22 inside the cylinder bores 1 through the shoes 23*a* and 23*b*. That is, the rotation of the swash plate 21 is converted into the reciprocation of the pistons 22. According to the reciprocation of the pistons 22, refrigerant gas of the inlet chamber 7 is sucked into the cylinder bores 1 and, after further compressed, is discharged into the discharge chamber 8. That is, compression of the refrigerant gas is executed.

During the compression of the refrigerant gas, the shoes 23*a* and 23*b* slide on the shoe receiving faces 24*a* and 24*b*. Lubricating oil is reserved in the crankcase 3. The lubricating oil enters, in the form of oil mist, from the ends of the shoe receiving faces 24*a* and 24*b* between the shoes 23*a* and 23*b* and the shoes receiving faces 24*a* and 24*b* for lubrication.

When each piston 22 is reciprocated, the refrigerant gas has a part passing as a blowby gas through a sealed gap 31 left around the piston-sealing member 25. For more preferable lubrication, on the way of compression of the piston 22, utilization is made of the blowby gas. That is, the blowby gas passes a clearance 32 between each piston 22 and an inner surface of the corresponding cylinder bore 1 and is supplied to sliding portions between the shoes 23*a* and 23*b* and the piston 22 and between the shoes 23*a* and 23*b* and the swash plate 21. As a result, the sliding portions are lubricated because the oil is contained in the blowby gas. The structure for this will be described now.

Figure 3:
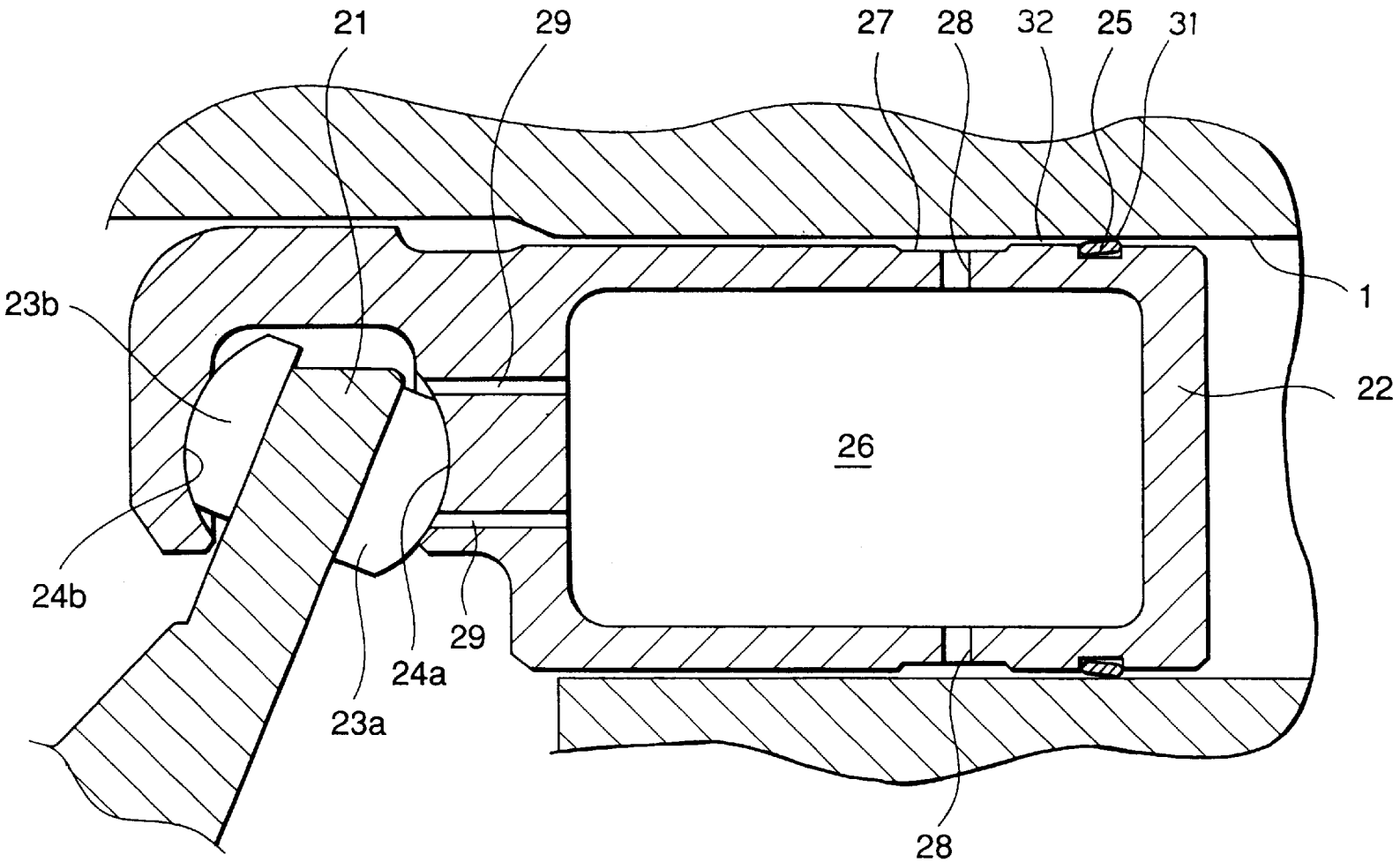
FIG. 3 is an enlarged longitudinal sectional view of the main part of the swash plate type compressor of FIG. 1 in a state where the piston is on the way between the top dead point and the bottom dead point.
Figure 4A:
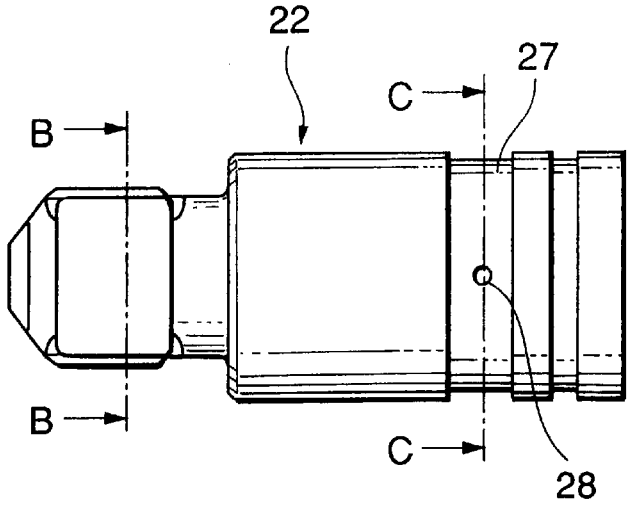
FIG. 4A is a side view of the piston of the swash plate type compressor of FIG. 1.
Figure 4B:
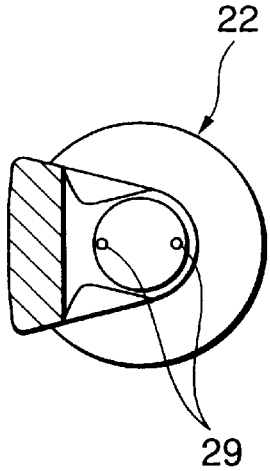
FIG. 4B is a sectional view taken along a line B—B of FIG. 4A.
Figure 4C:
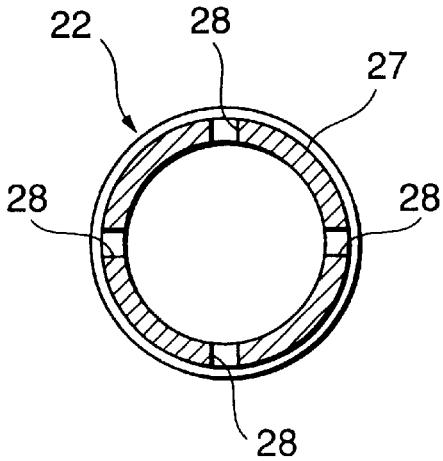
FIG. 4C is a sectional view taken along a line C—C of FIG. 4A.
Figure 5:
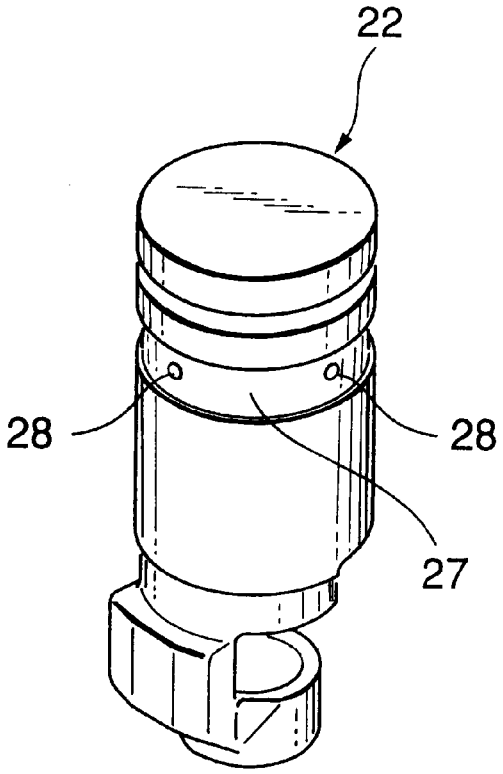
FIG. 5 is a perspective view of the piston of the swash plate type compressor of FIG. 1.

Referring to FIGS. 3 through 5 in addition to FIGS. 1 and 2, each piston 22 has an outer peripheral surface with a particular portion which is always fitted in each of the cylinder bores 1 even when the piston is reciprocated. Each piston 22 is in the form of hollow structure, i.e. has a hollow portion 26. The piston 22 also has a ring-like groove 27 circularly extending at the particular portion of the outer peripheral surface of each piston 22. The position of the ring-like groove 27 is closer to the crankcase 3 than the piston-sealing member 25 and is such a position as to never come off the cylinder bore 1 even when the piston 22 is at the bottom dead point as shown in FIG. 2.

A plurality of, for example four, gas inlets 28 are formed as a radial through hole in the bottom of the ring-like groove 27 around the axis of the piston 22 at equal intervals. The gas inlets 28 are through holes extending from the ring-like groove 27 to the hollow portion 26.

The piston 22 has a plurality of, for example two, gas outlets 29 formed as an axial through hole in the closed end thereof at the crank case 3 side. The gas outlets 29 are through holes extending from the hollow portion 26 to one of the aforementioned sliding portions i.e. one of the shoe receiving surfaces 24. A combination of the gas inlets 28, the hollow portion 26, and the gas outlets 29 serves a gas passage for introducing the blowby gas together with the lubricating oil to the sliding portions. A combination of the gas passage and the clearance 32 is referred to as a supply arrangement.

When the drive shaft 11 is driven to rotate, the rotor 17 and the swash plate 21 agitate the lubricating oil in the crankcase 3 so as to supply the lubrication oil directly to the aforementioned sliding portions.

On the way to the compression of the piston 22, the high-pressure blowby gas passing between the piston 22 and the cylinder bore 1 enters into the ring-like groove 27. Because of the pressure difference between the hollow portion 26 and the crankcase 3, the blowby gas further enters into the hollow portion 26 through the gas inlets 28 and reaches between the one shoe 23*a* and the one shoe receiving face 24*a* through the gas outlets 29. As a result, the oil in the blowby gas is supplied continuously into one of the sliding portions so that this portion is lubricated well.

The blowby gas from the gas outlets 29 further enters between the other shoe 23*b* and the other shoe receiving face 24*b*. As a result, the oil in the blowby gas is supplied into the other sliding portion so that this portion is lubricated well.

In this way, the oil in the blowby gas can rubricate the sliding portions of the shoes 23*a*, 23*b*, the pistons 22, and the swash plate 21. Particularly, much oil can be supplied to the shoe side to be compressed. Production of deteriorated objects in the lubricating oil due to the wear and heat of the shoe receiving surface 24*a* and the shoe 23*a*.

Figure 6:
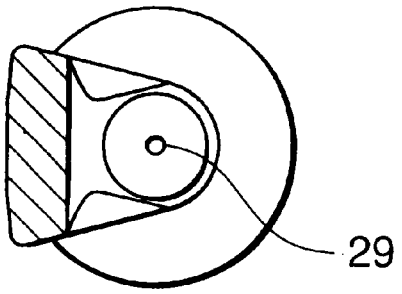
FIG. 6 is a view similar to FIG. 4B but showing a piston of a swash plate type compressor according to another embodiment of the present invention.

As shown in FIG. 6, the number of the gas outlets 29 may be one which is formed in the center of the piston 22.

Figure 7:
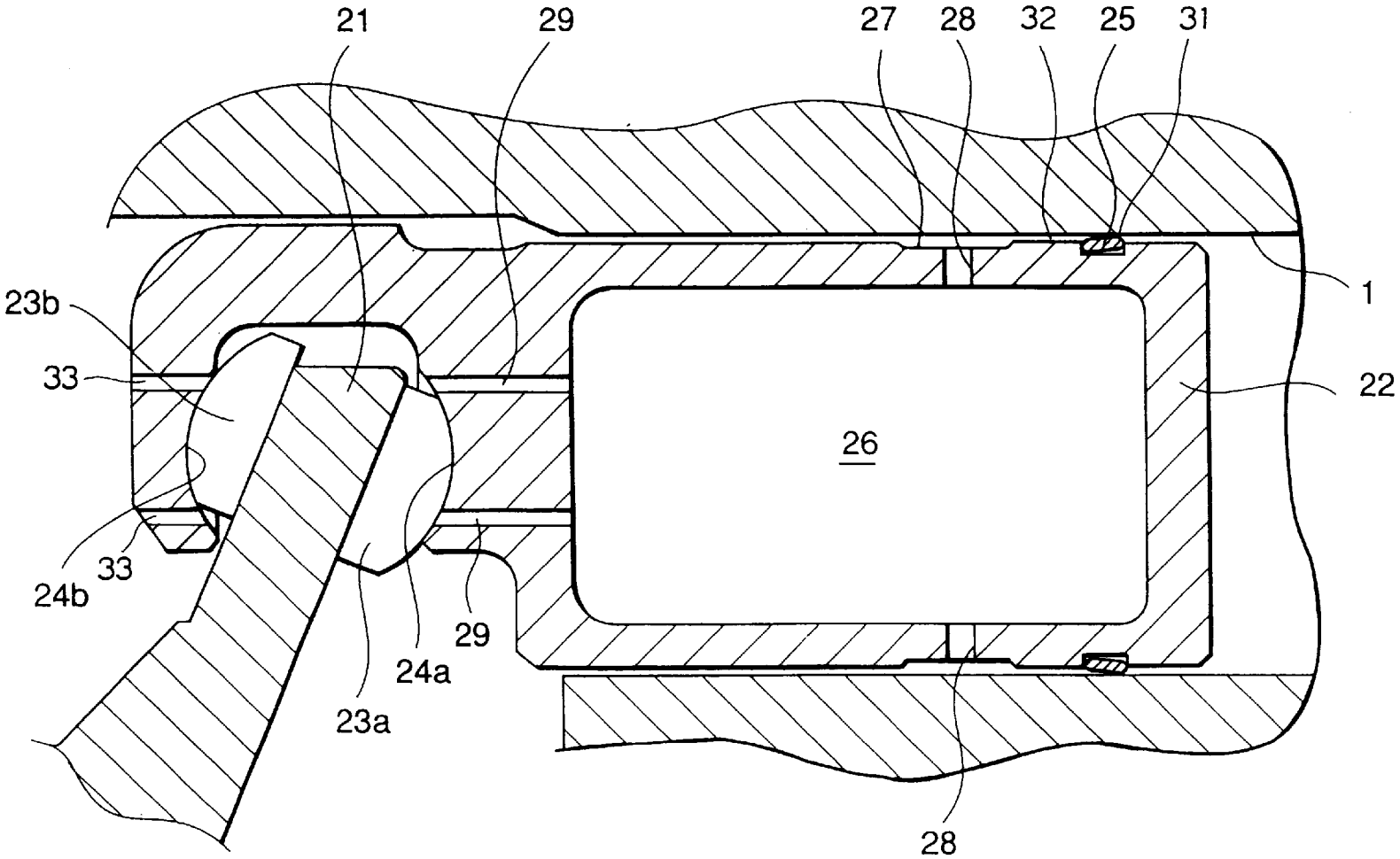
FIG. 7 is a longitudinal sectional view of a piston of a swash plate type compressor according to another embodiment of the present invention.

It is preferable that one or more of oil supply holes 33 are formed in a portion of the piston 22 where receives the other shoe 23*b* as shown in FIG. 7

Each of the swash plate type compressors described in the above can improve the reliability of a compressor because lubricating oil can be supplied well to sliding portions between pistons and shoes and between shoes and a swash plate.

While the present invention has thus far been described in connection with a few embodiments thereof, it will readily be possible for those skilled in the art to put this invention into practice in various other manners. For example, the present invention can be applied to a variable displacement compressor and, of course, to a double-headed-piston-type compressor.

What is claimed is:

1. A swash plate type compressor for compressing a gaseous fluid including lubricating oil, said swash plate comprising:

a cylinder block defining a cylinder bore;

a piston inserted in said cylinder bore to have a scaled gap around said piston and reciprocating to compress said gaseous fluid, said gaseous fluid having a part which passes as a blowby gas through said sealed gap when said piston is reciprocated;

a swash plate rotatably driven;

a shoe mechanism slidably interposed between said swash plate and said piston for converting a rotating motion of said swash plate to a reciprocating motion of said piston; and supply means connected to said sealed gap for supplying said blowby gas together with said lubricating oil to said shoe mechanism to lubricate a sliding portion which is between said shoe mechanism and each of said swash plate and said piston, wherein said supply means comprises a gas passage which is formed in said piston and opens between said piston and said shoe mechanism and introduces said blowby gas together with said lubricating oil into said sliding portion.

2. A swash plate type compressor as claimed in claim 1, wherein said piston has an outer peripheral surface with a particular portion which is always fitted in said cylinder bore even when said piston is reciprocated, said gas passage having an inlet formed at said particular portion.

3. A swash plate type compressor as claimed in claim 2, wherein said piston has:

a hollow portion therein;

a ring-like groove circularly extending at said particular portion;

a radial through hole extending from said ring-like groove to said hollow portion; and an axial through hole extending from said hollow portion to said sliding portion, a combination of said hollow portion, said ring-like groove, and said radial and said axial through holes serving as said gas passage.

4. A swash plate compressor as claimed in claim 1, wherein said gas passage opens towards said shoe mechanism.

* * * * *